US005636573A

United States Patent [19]

Brennan

[11] Patent Number: 5,636,573

[45] Date of Patent: Jun. 10, 1997

[54] CYLINDER POSITIONING APPARATUS FOR OFFSET PRESSES AND DUPLICATORS

[76] Inventor: Thomas M. Brennan, 514 W. Moyamensing, Philadelphia, Pa. 19148

[21] Appl. No.: 678,258

[22] Filed: Jul. 11, 1996

Related U.S. Application Data

[62] Division of Ser. No. 274,053, Jul. 12, 1994, Pat. No. 5,546,669.

[51] Int. Cl.[6] ..... B41J 1/32

[52] U.S. Cl. ..... 101/486; 101/211

[58] Field of Search ..... 101/181, 211, 101/248, 183, 485, 486; 33/614, 617, 618, 619, 620, 621

[56] References Cited

U.S. PATENT DOCUMENTS

| | | | |
|---|---|---|---|
| 1,014,446 | 1/1912 | Butler . | |
| 1,067,067 | 7/1913 | Schlueter, Jr. . | |
| 1,160,579 | 11/1915 | Connelly . | |
| 1,231,479 | 6/1917 | Blumer . | |
| 1,563,534 | 12/1925 | Smith . | |
| 2,153,534 | 4/1939 | Faught | 33/181 |
| 2,172,279 | 9/1939 | Hamilton, Jr. | 101/217 |
| 2,231,187 | 2/1941 | Hawley | 101/171 |
| 2,602,237 | 7/1952 | Navarre | 33/184.5 |
| 2,632,957 | 3/1953 | Gardner | 33/184.5 |
| 2,641,181 | 6/1953 | Leeberg | 101/174 |
| 3,090,129 | 5/1963 | Gifford | 33/184.5 |
| 3,969,826 | 7/1976 | Ottenhues et al. | 33/184.5 |
| 4,212,111 | 7/1980 | Saari | 33/181 R |
| 4,321,869 | 3/1982 | Jeschke et al. | 101/136 |
| 4,419,831 | 12/1983 | Zimmer | 33/181 R |
| 4,450,629 | 5/1984 | Force | 33/184.5 |
| 5,075,980 | 12/1991 | Kerman | 33/618 |
| 5,531,162 | 7/1996 | Iwamoto | 101/486 |

*Primary Examiner*—Ren Yan

*Attorney, Agent, or Firm*—Caesar, Rivise, Bernstein, Cohen & Pokotilow, Ltd.

[57] ABSTRACT

A method for vertically aligning the color plate cylinders of a press, which prints a two-color image on paper, in order to eliminate the vertical misalignment of the colors in the image printed. The method requires the use of a cylinder positioner that is releasably mounted on the press and involves operating the press to initially print the image, detaching the cylinder positioner from the press, adjusting the position of a positioner stop on the cylinder positioner based on the amount of misalignment in the printed image, reattaching the cylinder positioner, decoupling a color plate cylinder from normal operation, rotating the press's blanket cylinder until it impacts the positioner stop on the cylinder positioner, recoupling the color plate cylinder and then operating the press to correctly print the image.

8 Claims, 14 Drawing Sheets

FIG. 10
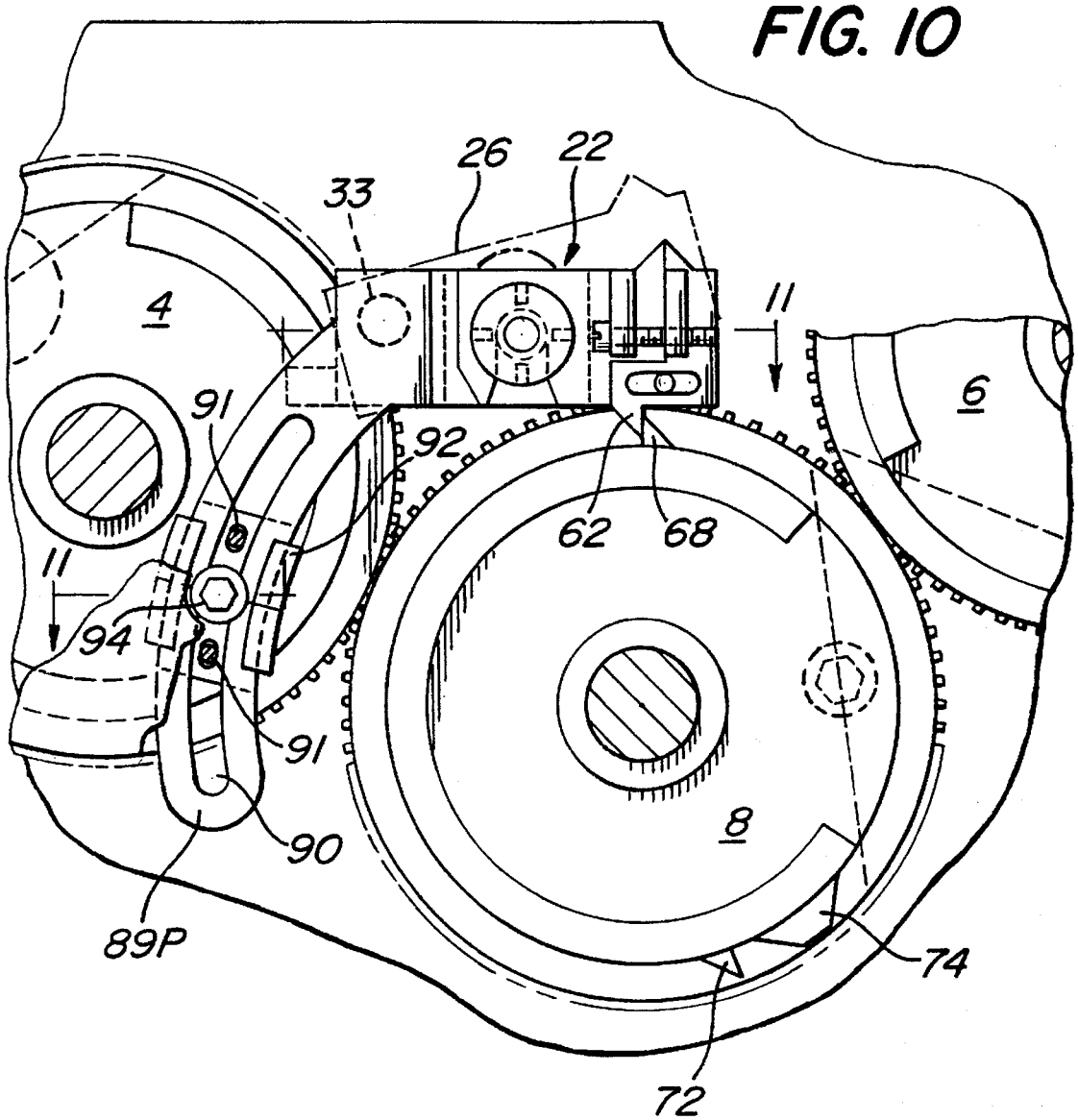
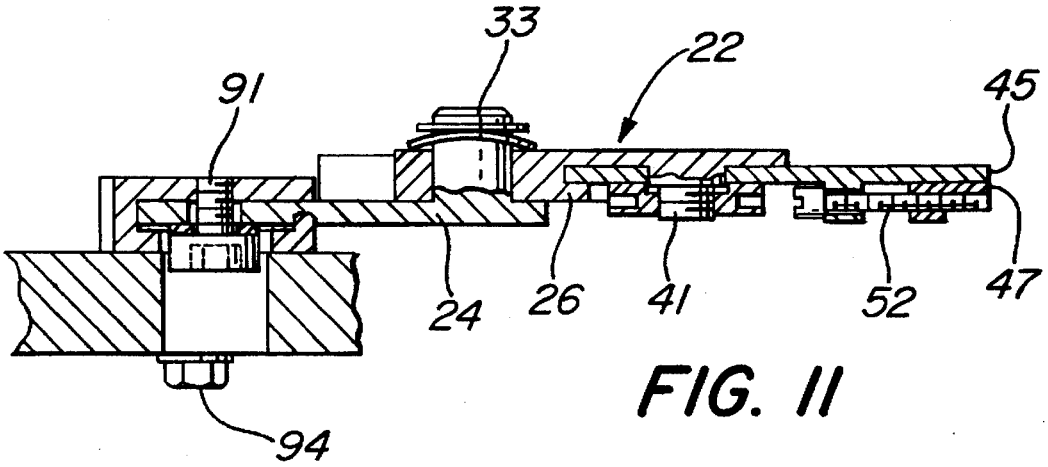
FIG. 11

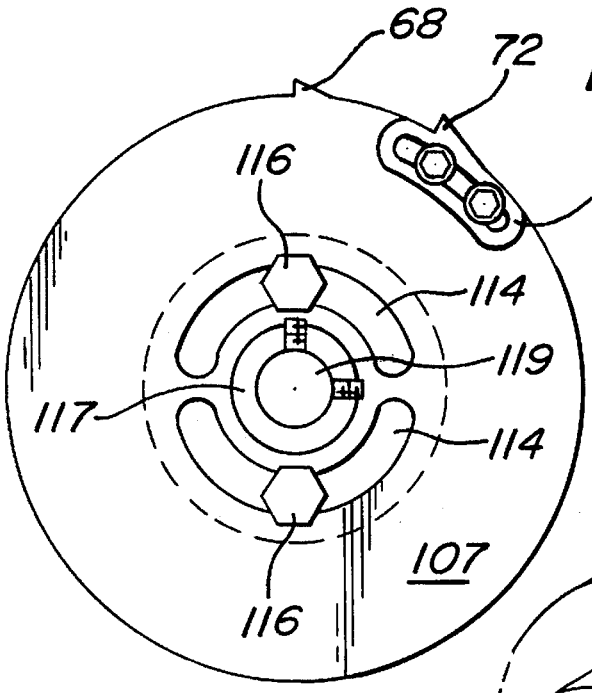
FIG. 19
FIG. 20
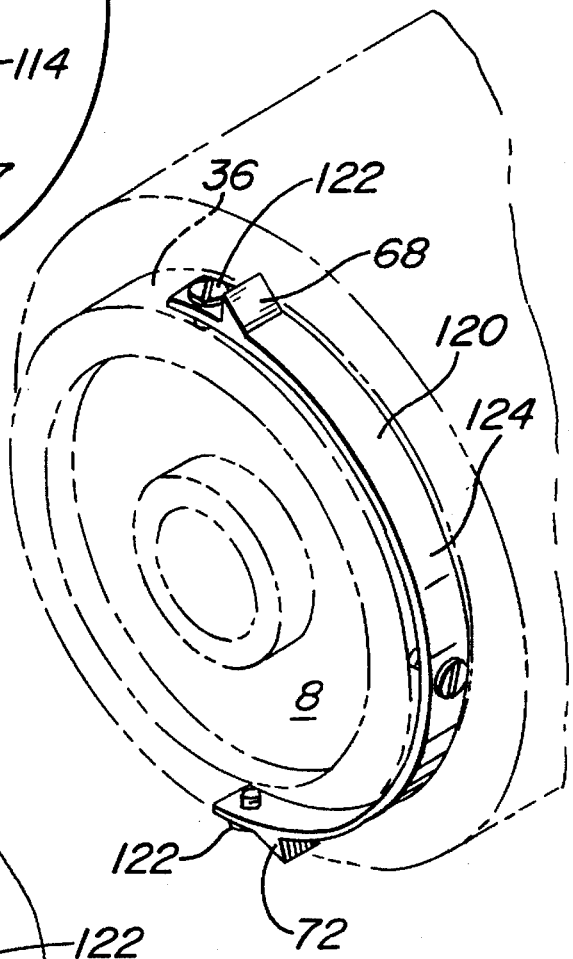
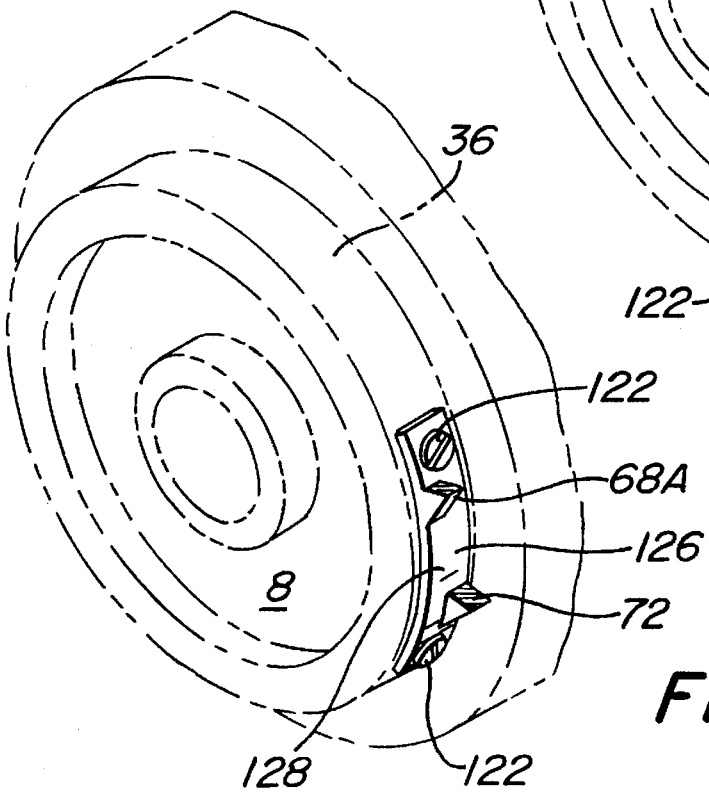
FIG. 21

CYLINDER POSITIONING APPARATUS FOR OFFSET PRESSES AND DUPLICATORS

RELATED APPLICATIONS

This invention is a divisional application of U.S. patent application Ser. No. 08/274,053, filed on Jul. 12, 1994 now U.S. Pat. No. 5,546,669, whose disclosure is incorporated by reference herein.

BACKGROUND OF THE INVENTION

This invention relates to cylinder positioners for offset presses and duplicators, and more particularly, to a cylinder positioning apparatus which can be added to, or manufactured with, presses and duplicators to obtain color registration rapidly and efficiently.

In the printing of multicolor images, it is important that the registration of each color where it borders on another color be proper. Fine adjustments must be made to the printing presses to prevent misalignment of the colors, i.e., wherein the colors overlap each other or when there is a gap between the colors.

In most cases, for two-color presses, the operator uses "eyeballing" to adjust the cylinders of the presses. After the plates have been placed upon the first and second color cylinders, the operator prints some images on paper and check the registration of the colors on the paper. Depending on whether there is overlap or a gap, the operator changes the vertical positioning of the colors of the image on the paper by rotating and changing the relative positions of either one or both of the color plate cylinders with respect to the blanket cylinder to correct the misalignment of the colors. This is a time-consuming, tedious operation which requires a high degree of skill on the part of the operator.

Various devices are known for correcting misregistration of the colors printed by multicolor presses. There are two main categories of devices, those which align the plate cylinders and those which align the plates on the plate cylinders.

Patents which disclose devices for alignment of plate cylinders in multicolor presses include U.S. Pat. No. 2,172,279 (Hamilton, Jr.) which uses arcuate slots to provide for adjustable rotation of the print cylinders; U.S. Pat. No. 2,602,237 (Navarre) which uses a glass plate and transparencies to line up coaxial printing cylinders; U.S. Pat. No. 3,969,826 (Ottenhues et al.) which discloses a gauge and a method for lining up plate cylinders or presses with multiple color stations; U.S. Pat. No. 4,321,869 (Jeschke, et al.) which discloses a drive with a gear train for alignment and keeping cylinders in synchronization; and, U.S. Pat. No. 5,075,980 (Kerman) which discloses an alignment plate for lining up plate cylinders which can be removably attached to the press.

Patents which disclose devices and instruments for alignment of plates mounted on the print cylinders of multicolor presses include U.S. Pat. No. 1,067,067 (Schlueter, et al.) which discloses a built-in plate registering device for multicolor presses; U.S. Pat. No. 1,160,579 (Connelly) which discloses a removably attached gauging device to adjust the plates; U.S. Pat. No. 2,641,181 (Leeberg) which discloses a gauge device successively mounted on printing cylinders to multistation color presses for plate positioning; U.S. Pat. No. 3,090,129 (Gifford) which discloses a bracket which supports a transparent sheet for positioning plates on cylinders; and, U.S. Pat. No. 4,450,629 (Force) which discloses a removable attachment for horizontally aligning plates.

Although the above devices assist the operator in obtaining proper registration of the colors, there is clearly a need for an apparatus which enables the operators of two-color presses to rapidly and efficiently obtain proper color registration for their production runs and which is inexpensive, easy to manufacture, and easy to use.

OBJECTS OF THE INVENTION

It is the general object of this invention to provide a cylinder positioning apparatus for offset presses and duplicators which overcomes the limitations of, and improves upon, the prior art.

It is a further object of this invention to provide a cylinder positioning apparatus for offset presses and duplicators which is inexpensive, easy to manufacture, and easy to use.

It is a yet a further object of this invention to provide a cylinder positioning apparatus for offset presses and duplicators which enables the operator of color presses to rapidly and efficiently obtain color registration.

It is still yet a further object of this invention to provide a cylinder positioning apparatus for offset presses and duplicators which can be installed on color presses during manufacture or which can be installed on existing color presses.

It is another object of this invention to provide a cylinder positioning apparatus for offset presses and duplicators which has a micrometer adjustment for enabling the operators of color presses to accurately position each of the color plate cylinders with relation to the blanket cylinder of the press.

It is still another object of this invention to provide a cylinder positioning apparatus for offset presses and duplicators which has an initial rest position when the press is operating and which can be moved to an adjustment position when in use.

It is still yet another object of this invention to provide a cylinder positioning apparatus for offset presses and duplicators which can be detached from its mounting bracket for adjustment of the positioner elements directly on the printed paper or which can be permanently attached to its mounting bracket and the paper brought to the press for adjustment of the positioner elements.

It is an additional object of this invention to provide a cylinder positioning apparatus for offset presses and duplicators with a mounting bracket which can accommodate large changes in the positioning of the cylinder positioner.

SUMMARY OF THE INVENTION

These and other objects of this invention are achieved by providing a cylinder positioning apparatus with a positioner adjustment member which is removably attached to a mounting bracket connected to the press. A first adjustment stop for positioning the primary or first color plate cylinder and a second adjustment stop for positioning the second color plate cylinder are installed on the blanket cylinder.

An adjustment screw is used to properly position the positioner stop to eliminate misalignment of the colors. The first and second cylinders are held stationary, in turn, while the blanket cylinder is rotated until the positioner stop contacts the first adjustment stop and the second adjustment stop, respectively. In addition, an elongated bracket with an elongated slot can be used to provide large changes in the positions of the plate cylinders with respect to the blanket cylinder.

BRIEF DESCRIPTION OF THE DRAWINGS

Other objects and many of the intended advantages of this invention will be readily appreciated when the same becomes better understood by reference to the following detailed description when considered in connection with the accompanying drawings wherein:

FIG. 10 is a side view of an alternative type of mounting for the pivot type of cylinder positioner which uses an elongated arcuate sweep bracket, to allow for large changes in the positioning of the cylinder positioner;

FIG. 11 is a sectional view of the cylinder positioner taken along the line 11—11 of FIG. 10;

FIG. 19 is a side view of an adjustment plate mounted on the end of any one-to-one shaft which rotates during vertical adjustment function, with a pair of semi-circular sweep adjustment mounting slots, a stationary first adjustment stop and a moveable second adjustment stop;

FIG. 20 is a perspective view of the front (operator's) end of the blanket cylinder showing a circular band with the adjustment stops mounted on the shoulder of the blanket cylinder;

FIG. 21 is a perspective view of the front end of the blanket cylinder with a band having an indented first adjustment stop and a projecting second adjustment stop.

DESCRIPTION OF THE PREFERRED EMBODIMENTS OF THE INVENTION

Figure 1:
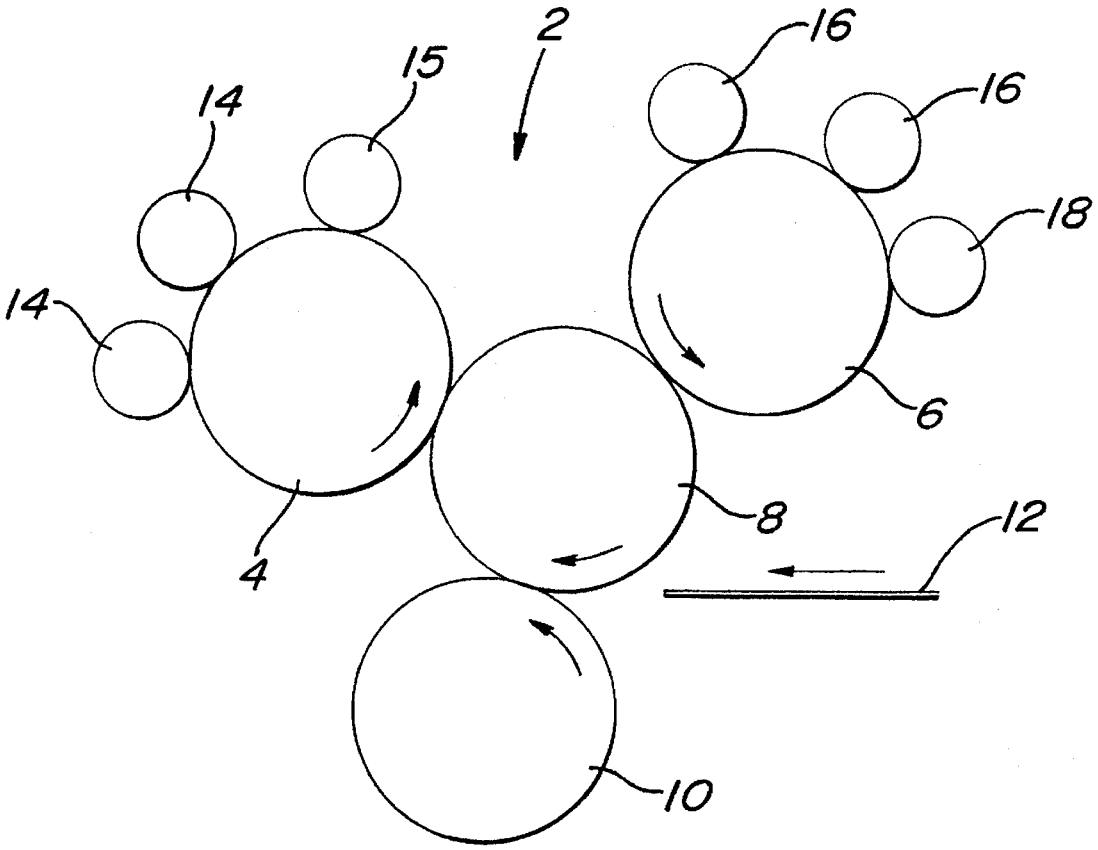
FIG. 1 is a diagrammatic representation showing the position of the rollers and cylinders in a two-color press.

Referring now in greater detail to the various figures of the drawing, wherein like reference characters refer to like parts, there is shown in FIG. 1 the rollers and cylinders of a typical common blanket two-color press 2. The two-color press 2 comprises a primary color plate cylinder 4, a second color plate cylinder 6, a blanket cylinder 8 and an impression cylinder 10. Associated with and in contact with the plate cylinder 4 are ink rollers 14 and a water roller 15. As is known to those familiar with the art, the ink on ink rollers 14 adheres to the lines on the image on the plate cylinder. The water is placed on the plate mounted on the plate cylinder 4, prior to the application of the ink, by the water roller 15, which will prevent the ink from the ink rollers 14 from adhering to the plate where there are no lines or images on the plate.

Similarly, for the second color plate cylinder 6, rollers 16, in contact with the plate cylinder 6, provide the ink of a second color to the plate cylinder with a water roller 18 preventing the ink from adhering to the plate where there are no lines or images to be reproduced from the plate mounted on the plate cylinder 6.

Images from the plate cylinder 4 and the plate cylinder 6 are passed onto the surface of the blanket cylinder 8 which combines the images of the two colors onto a single cylinder. The paper 12 moves in the direction of the arrow between the blanket cylinder 8, which has the two-color image, and the impression cylinder 10 which presses the paper against the blanket cylinder to produce a clear and sharp image.

The problem existing with multicolor presses is obtaining the exact alignment of the images on the blanket cylinder. Misalignment occurs when there is overlap between the image of one color and the image of another, or when they are separated by a gap. This is referred to as "vertical" misalignment in that the vertical positions of the images of the colors on the paper 12 must be corrected.

After the press has been set up, the operator will first run a few sheets of paper 12 through the press and visually examine two-color images for misalignment. The operator will then decide how much to change the relative positions of the plate cylinders 4 and 6 to the blanket cylinder 8 to remove the misalignment, Because the plate cylinders 4 and 6 and the impression cylinder 10 are geared to the blanket cylinder 8, the operator first decouples the plate cylinder to be adjusted from its gearing 70 (see FIG. 4). The press is then rotated by hand causing the blanket cylinder and the other cylinders to rotate while one of the plate cylinders is held stationary. This changes the relative position of the plate cylinder to the blanket cylinder. The operator may then adjust the other plate cylinder by similarly holding the other plate cylinder stationary while rotating the other cylinders.

After these adjustments have been completed, the operator performs another short printing run and rechecks the alignment of the colors on the paper.

This "eyeballing" process is time consuming and wasteful since the operator may overshoot or undershoot the alignment and have to realign several times before the impression of the colors on the paper is properly aligned.

Although most presses have means for setting a "Home Position" which approximately sets the proper positioning of the plate cylinder to the blanket cylinder, many of the presses lack micrometer adjustment means to rapidly align the cylinders to remove the slight misalignment in the colors due to inaccuracies of the printing plates or imperfections in the press, which is provided by the cylinder positioner of the invention. At "Home Position", the blanket cylinder is aligned with the plate cylinder (lead edge to lead edge).

Figure 2:
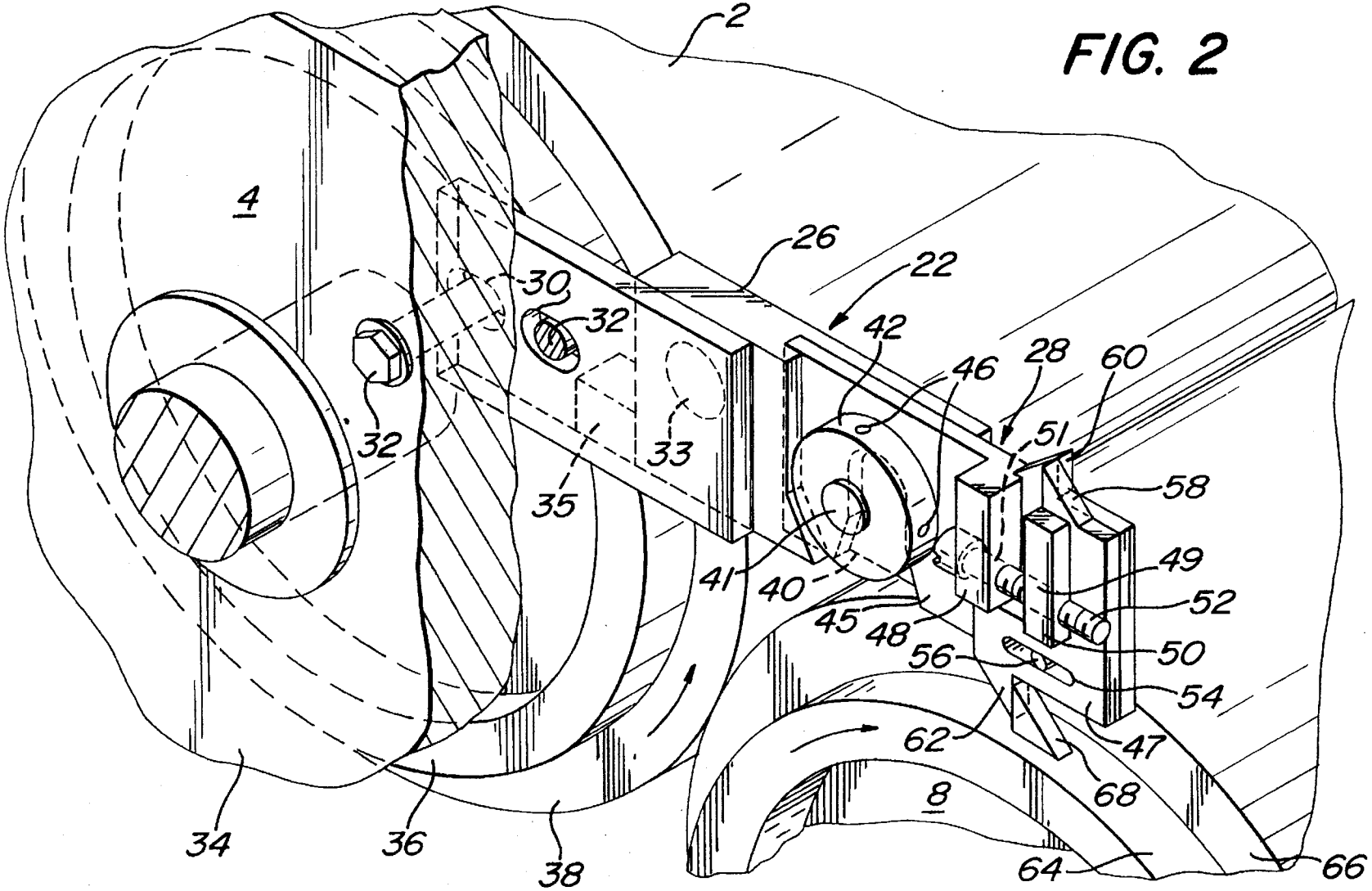
FIG. 2 is a perspective view, partially in section, from the front (operator's side) of the press, showing the cylinder positioner, with a pivot to move the positioner out of position when not in use, connected to the press.

Referring now to FIG. 2, the cylinder positioner 22 is mounted in the press 2. The cylinder positioner 22 comprises a mounting bracket 24, a positioner holding member 26 and a positioner adjustment member 28. The mounting bracket 24 has two elongated holes 30 and bolts 32 which connect the mounting bracket 24 to a casting 34 which forms part of the press 2. The elongated holes 30 enable the position of the cylinder positioner 22 to be varied as required. Also shown in FIG. 2 is a shoulder 36 (not available in all presses) and a side 38 of the primary color plate cylinder 4.

The positioner holding member 26 is coupled to the mounting bracket 24 by a joint 33. As will be described later, the positioner holding member 26 can be rotated about the joint 33, moving the cylinder positioner into a rest position when adjustments are not being made. The mounting bracket 24 also has a pivot stop 35 which limits the rotational motion of the positioner holding member 26 when it is rotated about the pivot 33.

The positioner adjustment member 28 has an open slot 40 into which a threaded bolt 41 can be inserted. A locking nut 42 which is threaded at the end of bolt 41 and tightened to connect the positioner adjustment member 28 to the positioner holding member 26, will hold the positioner member 28 in place. Allen wrench openings 46 are placed on the circumferential surface 48 of the locking nut 42 to enable tightening and loosening of the locking nut using a wrench.

The positioner adjustment member 28 comprises a stationary member 45 and a movable member 47. The stationary member 45 has a block 48 and the movable member 47 has a block 50 with a threaded hole 49. The cylinder positioner 22 also comprises a micrometer adjustment screw 52 which has a shaft which is positioned through a hole 51 in the block 48 and threaded into the threaded hole 49 in the block 50. An elongated slot 54 in the movable member 47 and a holding pin 56 permit the movable member 47 to move as the micrometer adjustment screw 52 is rotated.

The movable member 47 has a triangular pointer 58 and the stationary member 45 has a triangular pointer 60. The use of the micrometer adjustment screw 52 in conjunction with the pointers 58 and 60 to align the plate cylinders of the press will be explained in detail later. As the micrometer adjustment screw 52 is rotated, the relative position of a positioner stop 62 of the movable member 47 is changed.

The blanket cylinder 8 is also shown in the figure. The blanket cylinder 8 has a shoulder 64 and a side surface 66. The positioner apparatus also comprises an adjustment stop 68 and an adjustment stop 72 (see FIGS. 3 and 4), mounted on the shoulder 64. The adjustment stops 68 and 72 are used in conjunction with the positioner stop 62 to align the cylinders.

Figure 3:
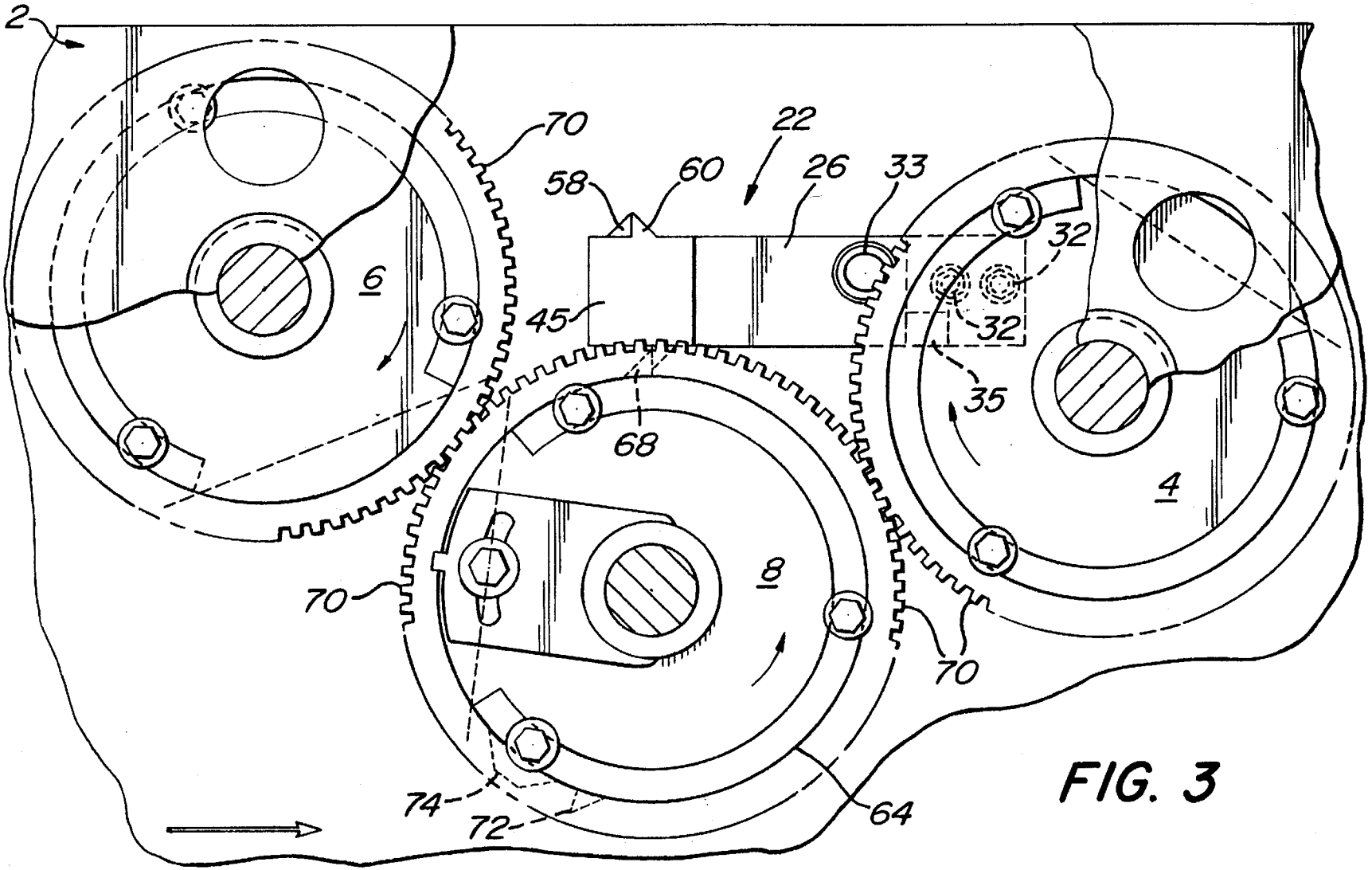
FIG. 3 is a side view of the back of the press, showing the two-color plate cylinders and the blanket cylinders with the cylinder positioner attached to the press.

FIG. 3 shows the cylinder positioner 22 mounted in the press 2 as viewed from the rear and non-operator side of the press. The plate cylinders 4 and 6 and the blanket cylinder 8 are geared together by the gearing 70 and rotated in the direction shown by the arrows. The triangular pointer 60 of the stationary member 45 is held stationary while the triangular pointer 58 of the movable member 47 is free to move in a horizontal direction relative to the triangular pointer 60 as will be described in the adjustment procedure later.

Figure 4:
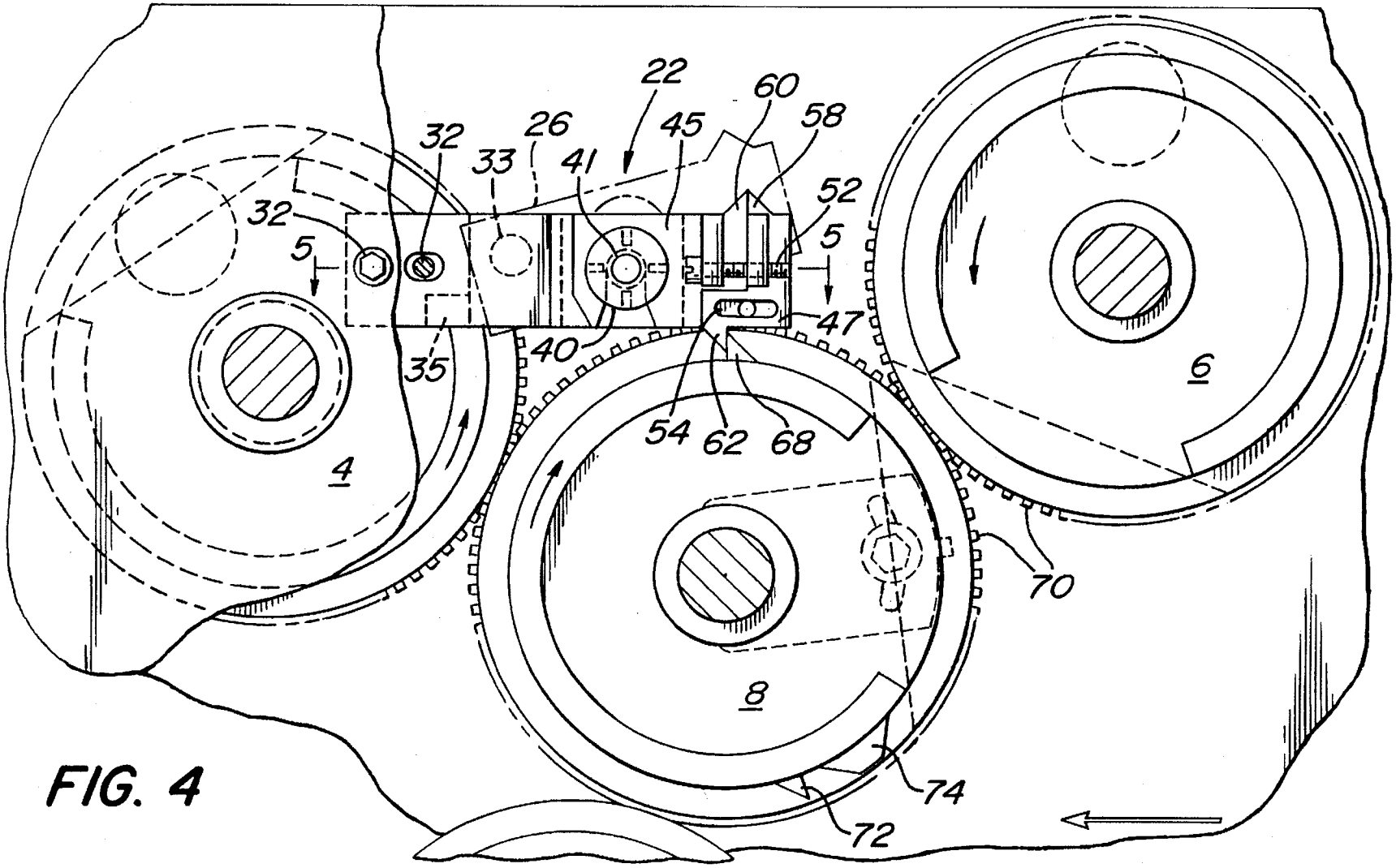
FIG. 4 is a side view of the front of the press with the cylinder positioner installed.

FIG. 4 shows the operator side of the press with the cylinder positioner 22 in place. Shown with dashed lines is the cylinder positioner holding member 26 in its rest position after it has been rotated about pivot 33. The plate cylinders 4 and 6 and the blanket cylinder 8 are shown geared together with the gearing 70. The cylinders rotate in the direction of the arrows when the press is in operation. The adjustment stop 68 is used for the adjustment of the primary plate cylinder 4 to its Home Position and the adjustment stop 72 is used for the adjustment of the second color plate cylinder 6 as will be described later. The apparatus may include a reset projection 74, mounted on the blanket cylinder to move the positioner stop 62 away from the adjustment stops 68 and 72 when the press is in operation. To this end, the height of the reset projection 74 is slightly larger than the heights of the adjustment stops 68 and 72.

As can be seen in the figure, when the micrometer adjustment screw 52 is rotated in one direction, the triangular pointer 58 will move to the right away from the triangular pointer 60 or to the left in front of the triangular pointer 60 when the adjustment screw 52 is rotated in the opposite direction.

Figure 5:
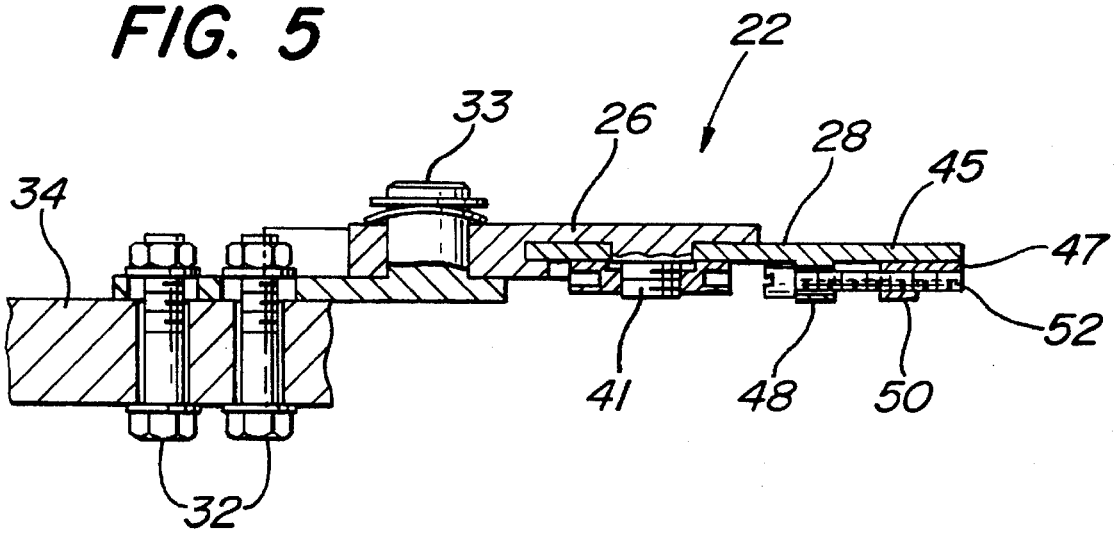
FIG. 5 is a sectional view of the cylinder positioner taken along the line 5—5 of FIG. 4.

The cylinder positioner 22 is shown in section in FIG. 5. The bolts 32 connect the cylinder positioner to the casting 34 of the press 2. As can be seen in the figure, as the micrometer adjustment screw 52 is rotated, the movable member 47 is free to move to the right or to the left in the space between the stationary member 45 and the micrometer adjustment screw 52.

Figure 6:
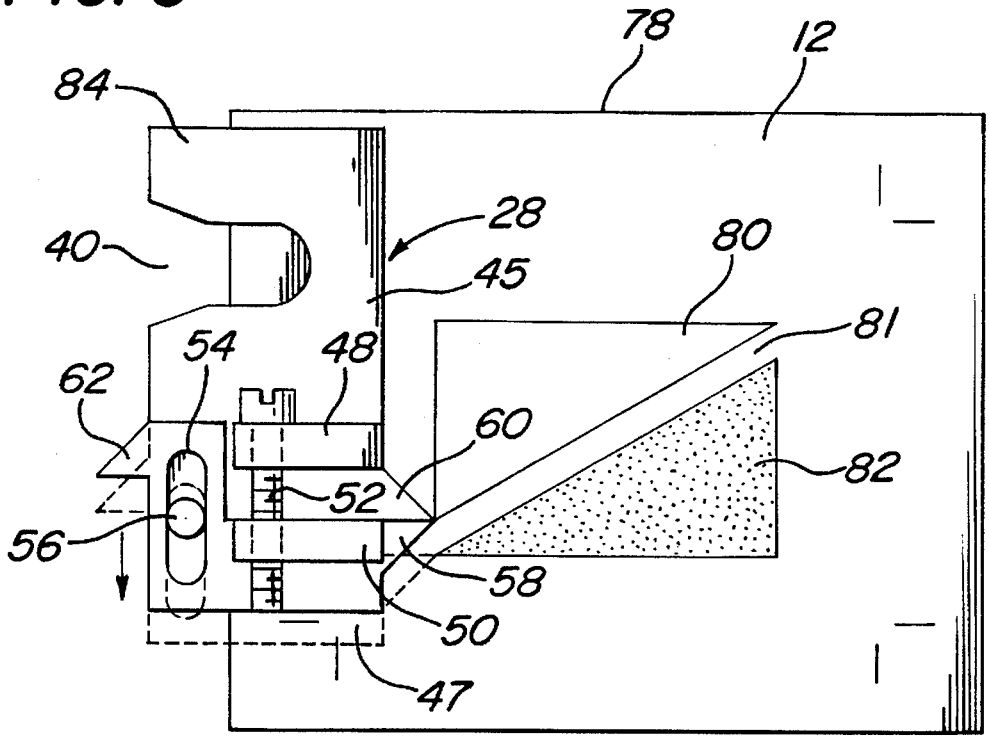
FIGS. 6 & 7 are top views of the cylinder positioner showing the positioning of the cylinder positioner adjustment member placed on paper with a two-color impression for making the micrometer adjustment to the cylinder positioner.

When the press has been initially set up, and images have been printed on a few pieces of the paper 12, the positioner adjustment member 28 is removed from the positioner holding member 26 by loosening the locking nut 42. The positioner adjusting member 28 has a gripper edge 84, as shown in FIG. 6. The paper 12 has an image 80 of one color, an image 82 of a second color and an upper (paper gripper) edge 78. As can be seen in the figure, the second color image 82 is positioned below, and there is a gap 81 between the images 80 and 82. The positioner adjustment member 28 is placed on the paper so that its gripper edge 84 is adjacent and parallel to the top edge 78 of the paper 12. The pointer 60 is lined up with the lower edge of the image 80 at the gap 81, and the micrometer screw 52 is rotated until the pointer 58 is positioned at the position of the upper edge of the color image 82, as shown by the dashed lines. Thus, the distance between the tips of the triangular pointers 58 and 60 is equal to the amount of vertical misalignment between the images 80 and 82 on the paper 12. As the micrometer adjustment screw 52 is rotated separating the pointers 58 and 60, the movable member 47 moves in the direction of the arrows, thereby repositioning the positioner stop 62 with relation to the stationary member 45.

Figure 7:
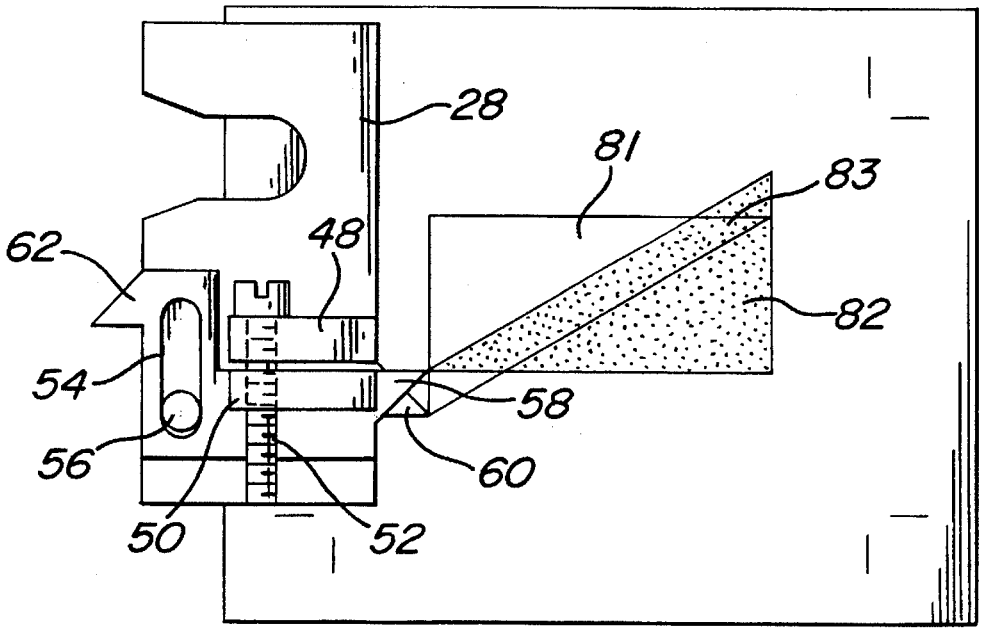

FIG. 7 shows the adjustment of the cylinder positioner in case of overlap 83 of the colors instead of a gap between the colors of FIG. 6. In this case, the pointer 58 is moved toward and past the pointer 60 by a distance equal to the vertical overlap.

Referring once more to FIG. 4, the cylinder positioning procedure will now be described.

It is assumed that the primary plate cylinder has already been aligned to its "Home Position", i.e., the blanket cylinder has been rotated with the primary plate cylinder stationary by decoupling it from its gearing 70, so that the adjustment stop 68 abuts the positioner stop 62. The "Home Position" adjustment need not normally be re-made except for small occasional adjustments to account for machine wear and tear or for large changes to move the image away from the paper gripper edge when desired.

To remove vertical misalignment, an image is then printed. The positioner adjustment member 28 (FIG. 2) is disconnected from the positioner holding member 26 by loosening the locking nut 42. The positioner adjustment member 28 is then adjusted as described previously positioning the positioner stop 62 to remove misalignment on the printed sample. The positioner adjustment member 28 is then reconnected to the holding member 26. The cylinder positioner holding member 26 is then rotated about the pivot 33 to its operating position. The second color plate cylinder 6 is decoupled from its gearing 70, using a standard tool, and the press is rotated so that the blanket cylinder moves in the direction of the arrow. This will cause the second color plate cylinder 6 adjustment stop 72 to rotate clockwise past the positioner stop 62. The blanket cylinder is then rotated in the opposite direction until the flat portions of the positioner stop 62 and the second color cylinder adjustment stop 72 are in contact, abutting each other.

The second color plate cylinder 6 is then recoupled to its gearing 70. The cylinder positioner 26 is rotated about pivot 33 to its rest position, and the operator operates the press to produce a few more printed images on paper. In most cases, the single adjustment will bring the colors into proper alignment. However, if a slight misalignment still exists, the operator repeats the procedure.

Figure 8:
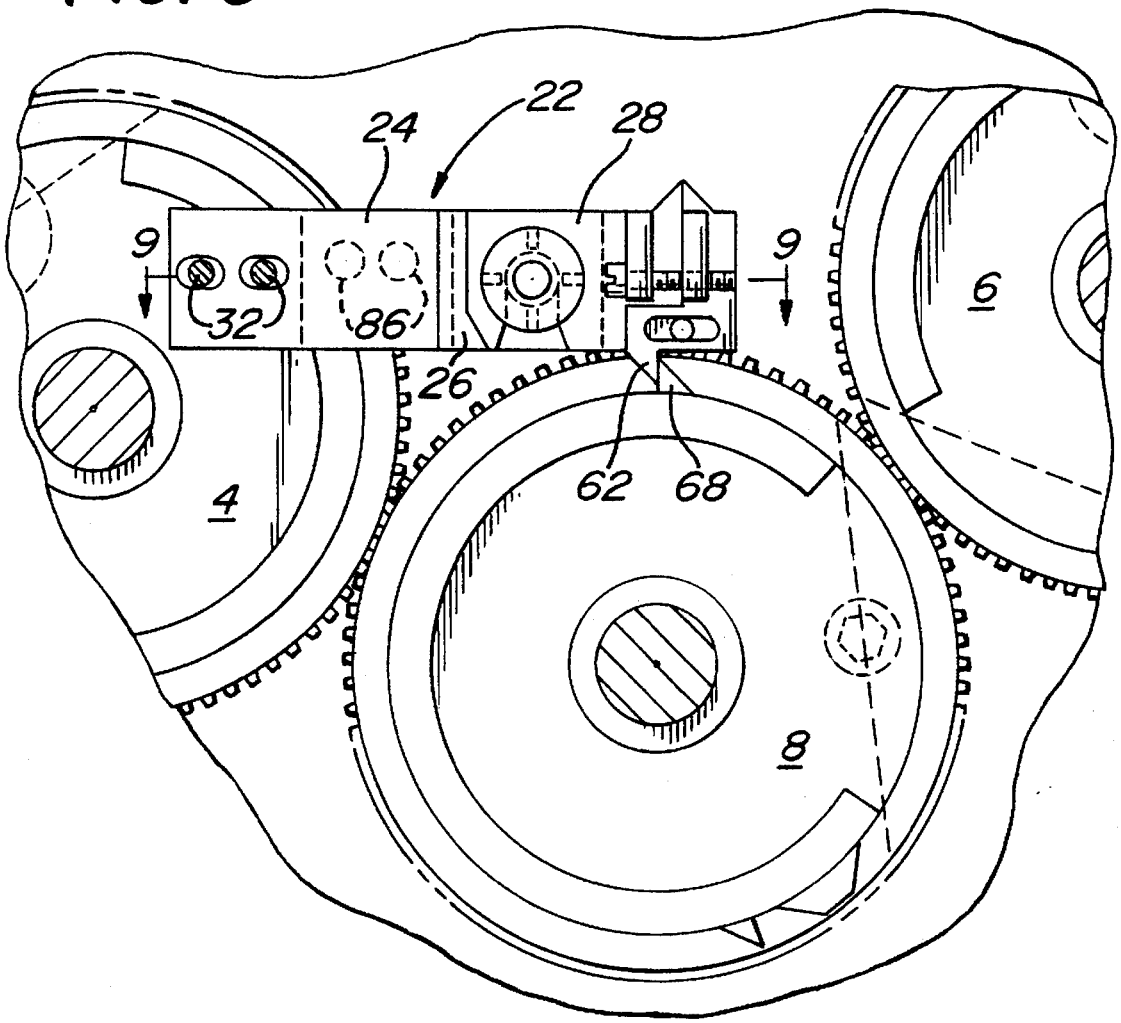
FIG. 8 is a side view showing an alternative embodiment of the cylinder positioner which uses spring-loaded posts to move the positioner out of position when it is not in use.
Figure 9:
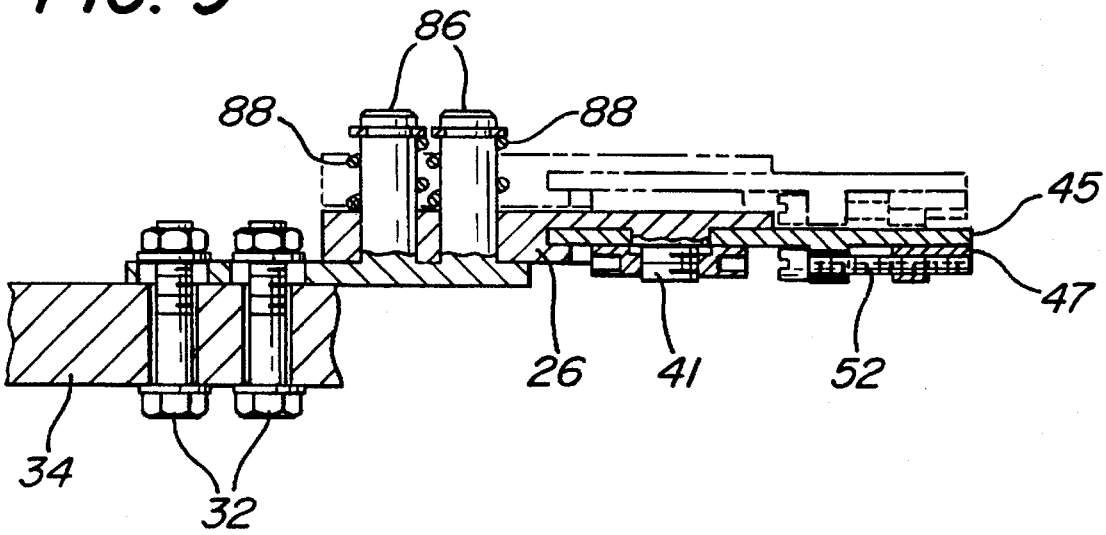
FIG. 9 is a sectional view of the cylinder positioner taken along the line 9—9 of FIG. 8.

FIGS. 8 and 9 show an alternative embodiment of the cylinder positioner wherein the bracket 24 comprises posts 86 which project through holes in the positioner holding member 26. Springs 88 on the posts 86 press downward upon the positioner holding member 26 keeping it in the retracted or rest position. To make the cylinder adjustments, the operator presses against the springs 88, moving the cylinder positioner holding member 26 into its operating or adjustment position as shown by the dashed lines in FIG. 9.

Another embodiment of the apparatus is shown in FIGS. 10 and 11. In this case the apparatus comprises sweep bracket 89P (hereinafter, 89P refers to sweep brackets with a pivot and 89S refers to sweep brackets which are spring loaded) having an arcuate slot 90, a fixed bracket 92 and a clamping nut 94. The sweep bracket 89P is mounted within, and can move within, a fixed bracket 92. The sweep bracket also includes screws 91 which connect the fixed bracket 92 to the press. Therefore, the cylinder positioner 22 can be moved a much greater distance with respect to the blanket cylinder 8 than was the case with the mounting bracket 24 of the previous embodiments. The clamping nut 94 holds the cylinder positioner 22 in position after the position has been set. The sweep bracket 89P enables the cylinder positioner to be used to move an image on the paper several inches. In FIGS. 10 and 11, the pivot type of cylinder positioner is shown.

Figure 12:
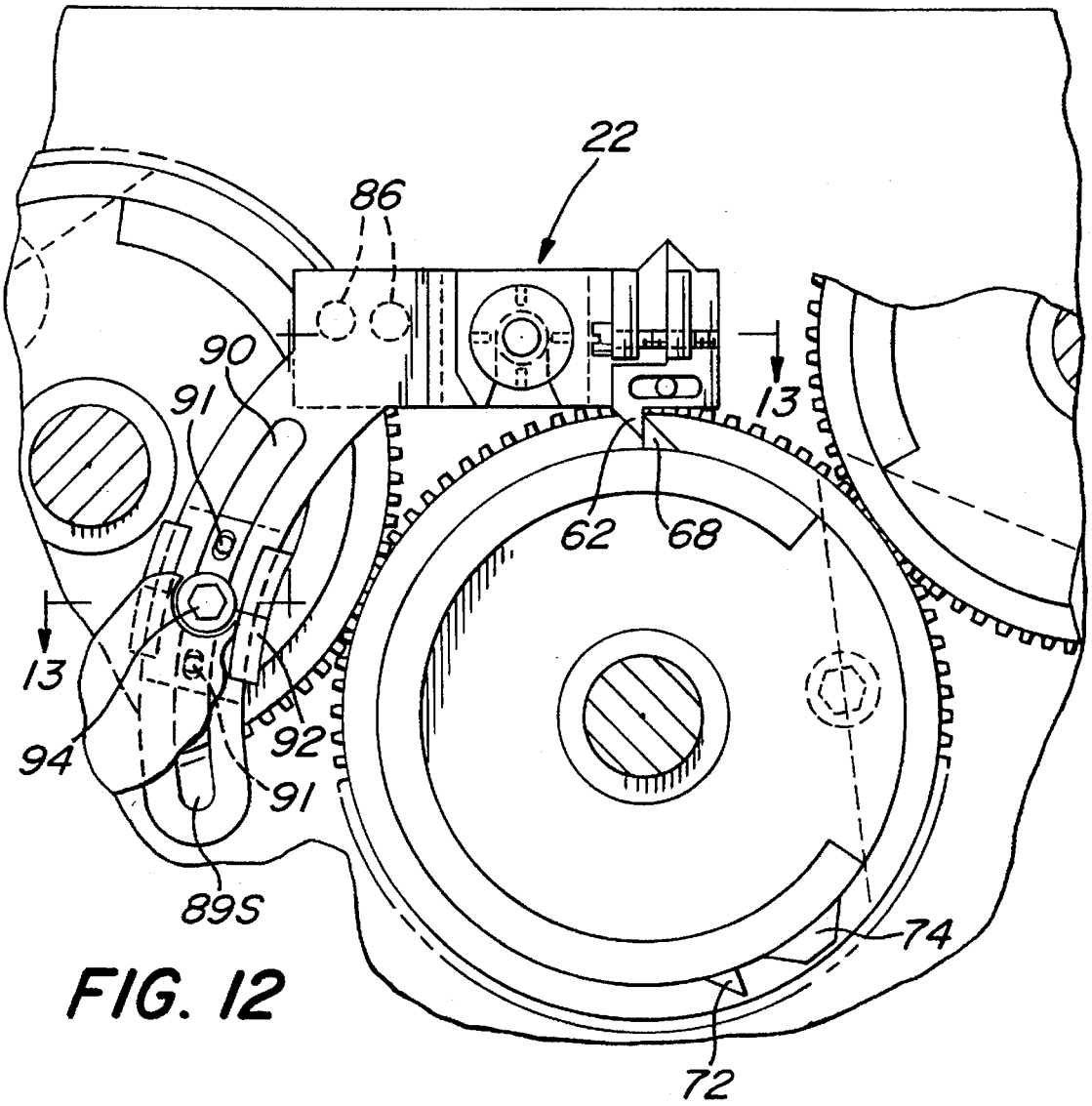
FIG. 12 is a side view showing the cylinder positioner with the spring-loaded return and the elongated arcuate sweep bracket.
Figure 13:
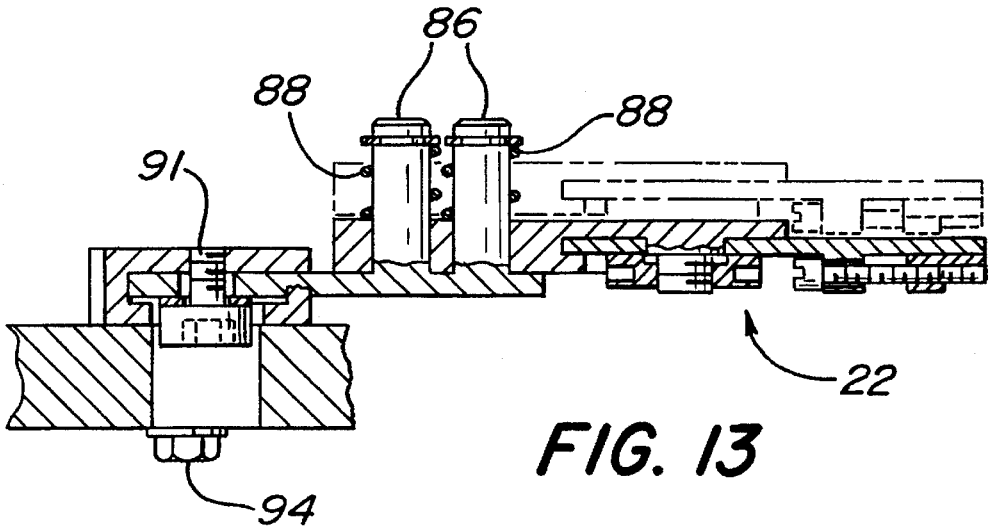
FIG. 13 is a sectional view of the cylinder positioner taken along the line 13—13 of FIG. 12.

FIGS. 12 and 13 show another combination of the cylinder positioner and elongated arcuate sweep bracket 89S. The cylinder positioner 22 in this case uses the spring-loaded post embodiment for setting the positioner holding member 26 in its operating position.

Figure 14:
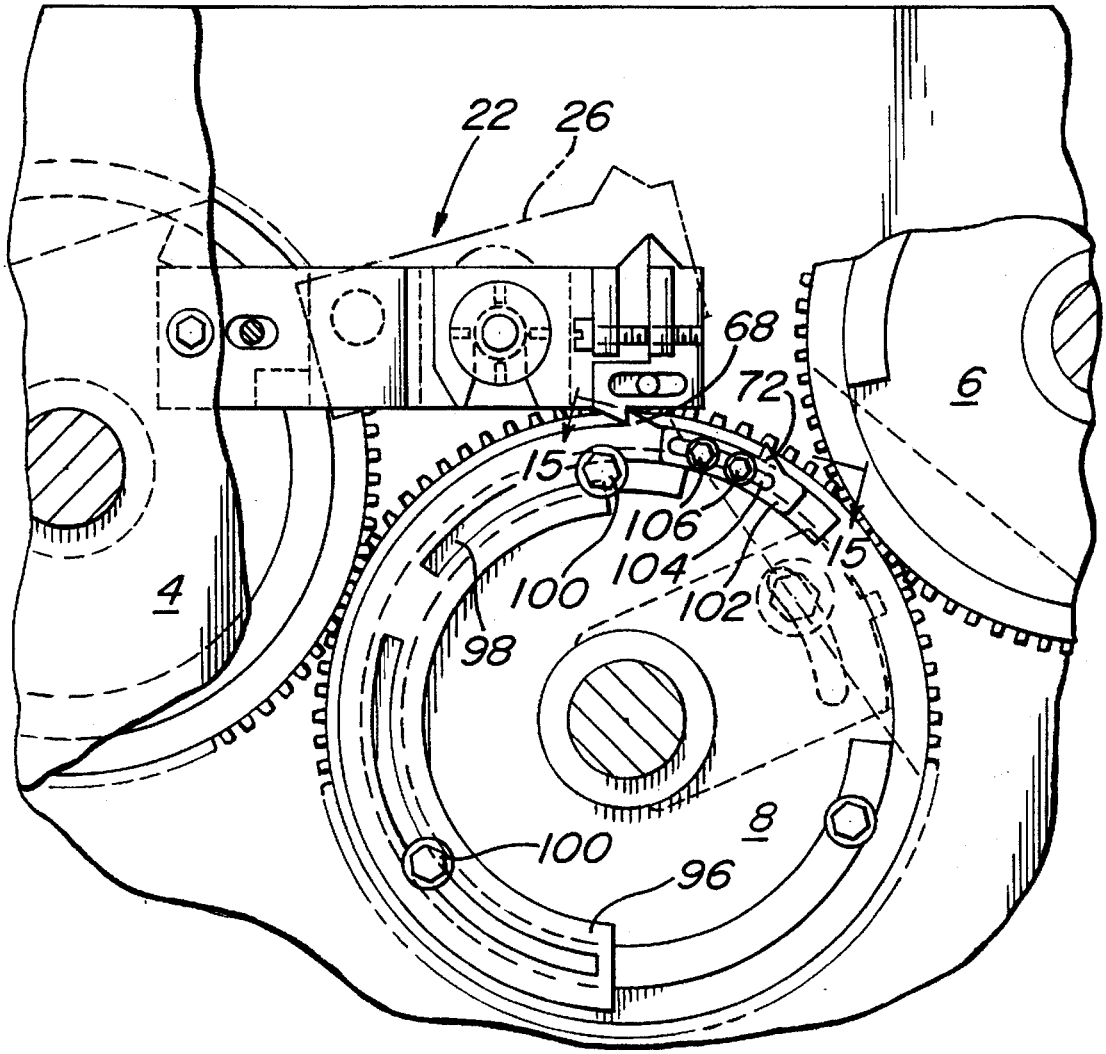
FIG. 14 is a side view of the cylinder positioner with a bracket for adjusting the position of the second adjustment stop relative to the position of the first adjustment stop, connected to a sweep bracket mounted on the blanket cylinder.
Figure 15:
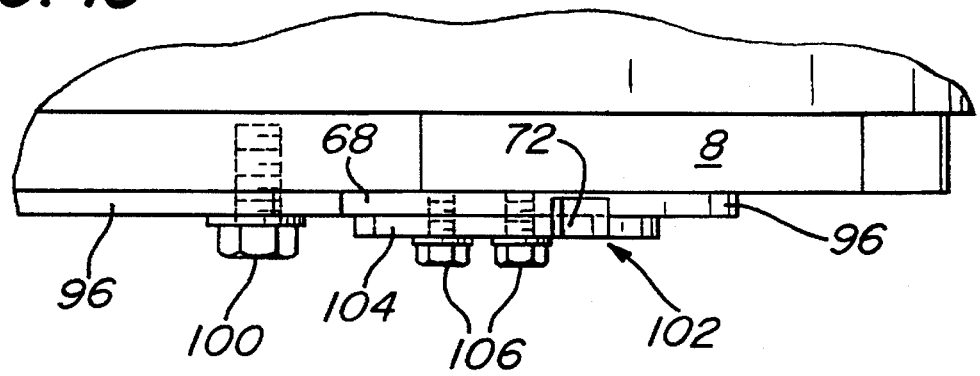
FIG. 15 is a sectional view of the adjustment stop bracket taken along the line 15—15 of FIG. 14.

FIGS. 14 and 15 show an alternative embodiment of the sweep adjustment means as well as a means for adjusting the relative positions of the adjustment stops 68 and 72. The apparatus comprises an elongated arcuate sweep bracket 96 with arcuate slots 98 and clamping nuts 100 which clamp the sweep bracket 96 to the end of the blanket cylinder 8. When the clamping nuts 100 are loosened, the sweep bracket 96 can be repositioned, thereby repositioning the primary plate cylinder adjustment stop 68 and the second cylinder adjustment stop 72.

In addition, the positioner apparatus also comprises a bracket 102 on which the second color adjustment stop 72 is mounted with an elongated arcuate slot 104 and bolts 106. The bolts 106 connect the arcuate slot 104 to the sweep bracket 96. When the bolts 106 are loosened, the bracket 102 can be moved, thereby changing the relative position between the adjustment stop 72 and the adjustment stop 68; the changing of the positioner stops 72 and 68 relative to each need only be performed during initial installation or after shifting due to wear and tear.

Figure 16:
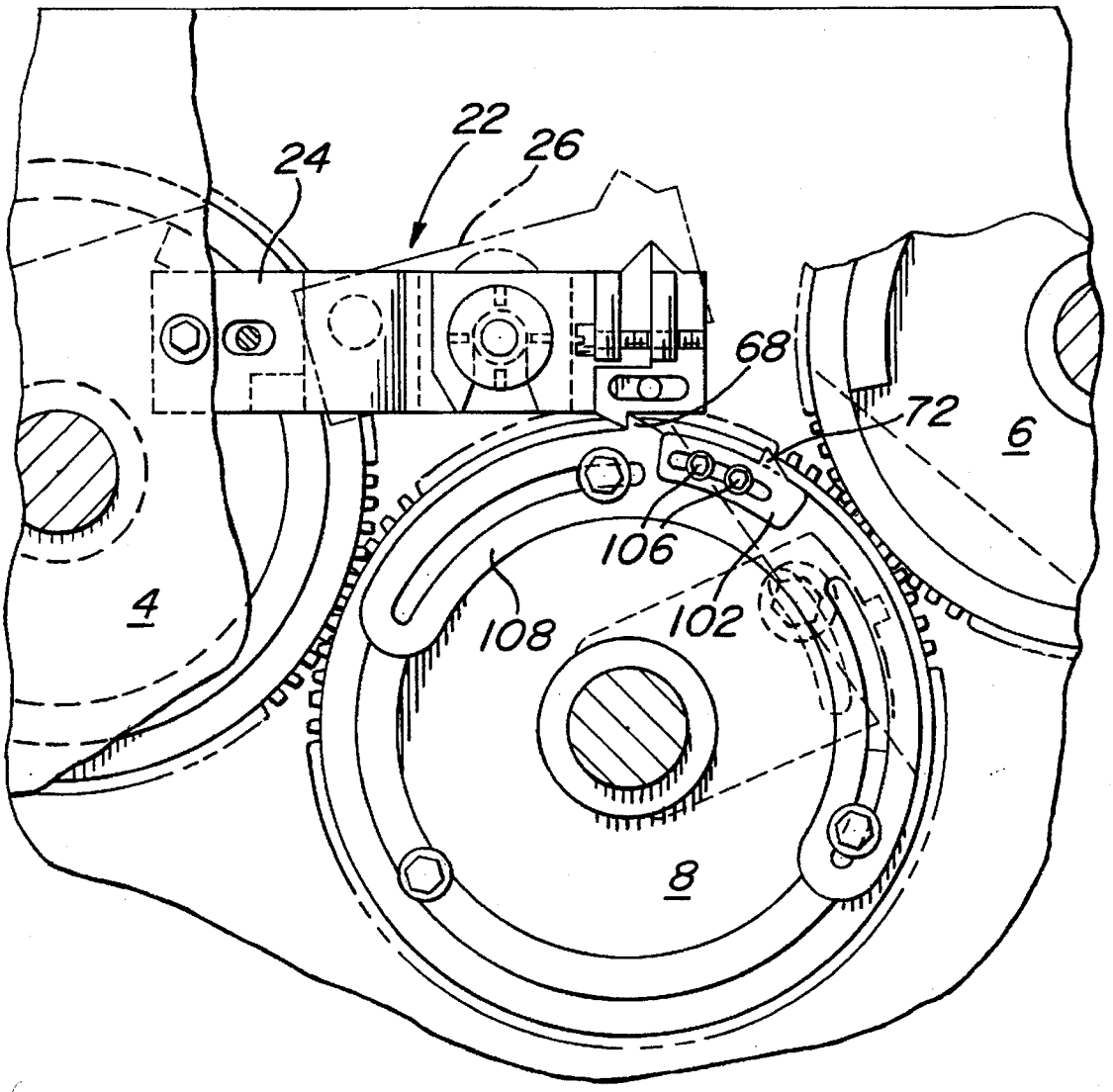
FIG. 16 is a side view of the press showing the cylinder positioner with a sweep bracket and a bracket for changing the relative position of the adjustment stops.
Figure 17:
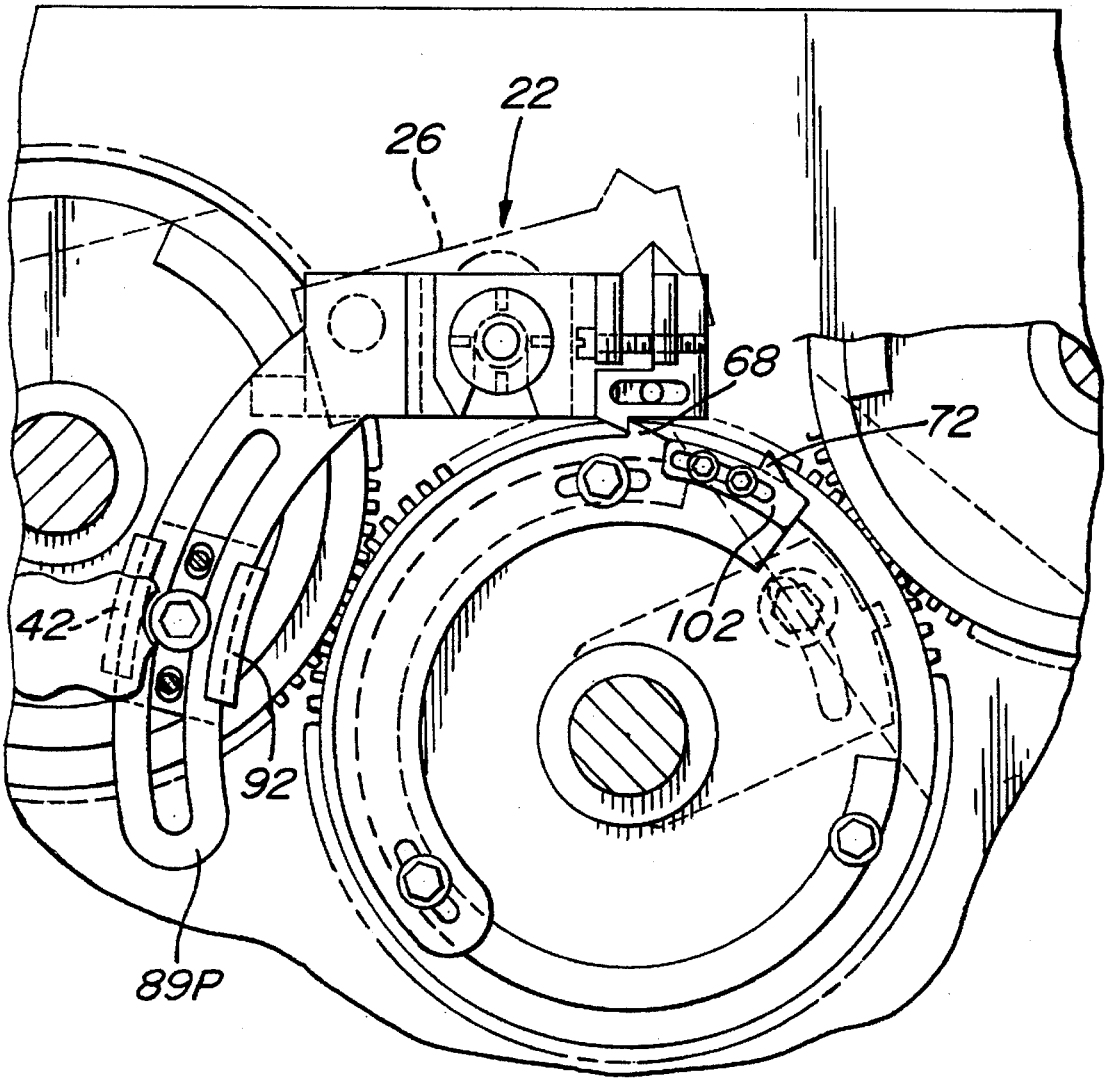
FIG. 17 is a side view of the press showing the cylinder positioner mounted on the sweep bracket with the bracket for changing the relative position of the adjustment stops mounted on the end of the blanket cylinder.
Figure 18:
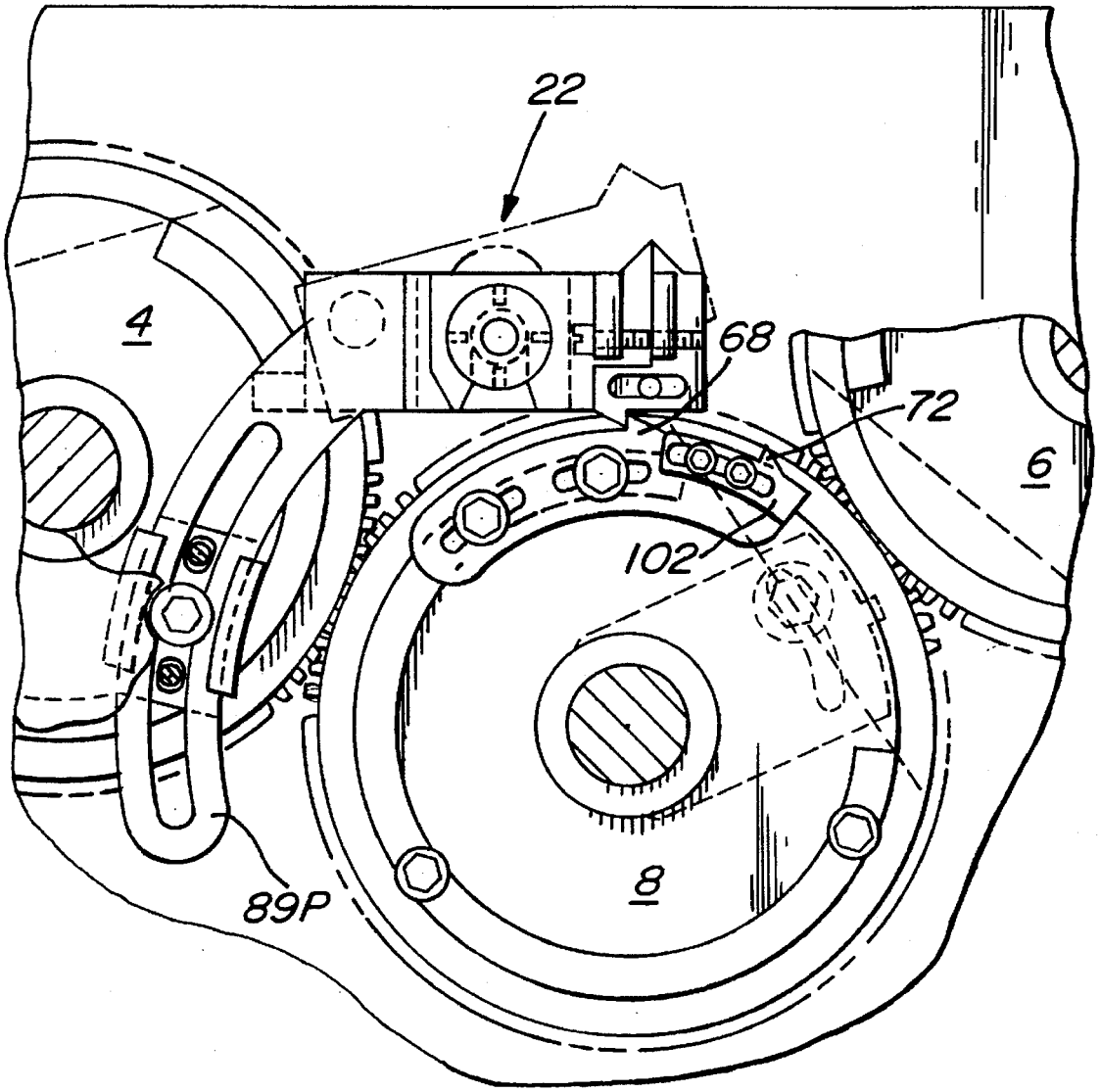
FIG. 18 is a side view of the press showing the cylinder positioner with the sweep bracket and the bracket for changing the relative positioning of the adjustment stops connected to an alternative arcuate bracket.

FIGS. 16, 17 and 18 show additional combinations of the cylinder positioner 22 with various mounting and adjustment brackets. FIG. 16 shows the original mounting 24 with an elongated arcuate partial sweep mounting 108 for positioning the adjustment stop 68 and the adjustment mounting bracket 102 for changing the position of the second adjustment stop 72 with relation to the position of the adjustment stop 68. FIG. 17 shows an elongated sweep bracket 89P mounted within bracket 92 together with the bracket 102 for changing the relative positions between adjustment stop 68 and adjustment stop 72.

FIG. 18 shows the cylinder positioner apparatus with the elongated arcuate sweep bracket 89P used in combination with the bracket 102 for positioning adjustment stop 72 in relation to adjustment stop 68.

FIG. 19 shows another alternative embodiment wherein the cylinder positioner apparatus comprises a circular plate 107, with an adjustment stop 68. The plate 107 is mounted on a hub and disk 117. The circular plate 107 can be mounted on the end of any shaft 119 which rotates one-to-one with the moving cylinders during vertical adjustment. The plate 107 has two semi-circular slots 114 and threaded bolts 116 which allow for changing the position of the plate 107, thereby repositioning the adjustment stop 68. The plate 107 is held in place by the threaded bolts 116 which are threaded into the face of the hub 117, which is bolted to the shaft 119.

FIG. 20 discloses another means for positioning the primary plate adjustment stop 68 and the second color adjustment stop 72. In this case, the cylinder positioner apparatus includes an arcuate strip 120 and threaded screws 122 which connect the arcuate strip 120 to the shoulder 36 of the blanket cylinder 8. The arcuate strip 120 comprises the adjustment stops 68 and 72 which project outwardly and upwardly from the surface 124 of the arcuate strip 120.

FIG. 21 illustrates another combination of adjustment stops 68 and 72. In this case, the cylinder positioner apparatus comprises an arcuate strip 126 having a surface 128, threaded screws 122, a primary cylinder adjustment stop 68A which is a cut in the arcuate strip 126 and a second color adjustment stop 72 which projects above the surface 128. Of course, any desired combinations of cuts or indentations versus projections can be used for the adjustment stops 68 and 72. For example, both adjustment stops can be projections, as shown in FIG. 20 and in the previous figures; adjustment stop 68 can be a cut or indentation with adjustment stop 72 as a projection; adjustment stop 68 can be a projection and the adjustment stop 72 can be a cut or indentation; or both adjustment stops 68 and 72 can be indentations. The cuts or indentations can be placed in the blanket cylinder 8 itself as well as on arcuate strip 126 as shown in the figure.

Although the embodiments heretofore described are intended for use on two-color presses, this invention can also be applied to single-color presses or to individual color stations of multi-station, multicolor presses.

Figure 22:
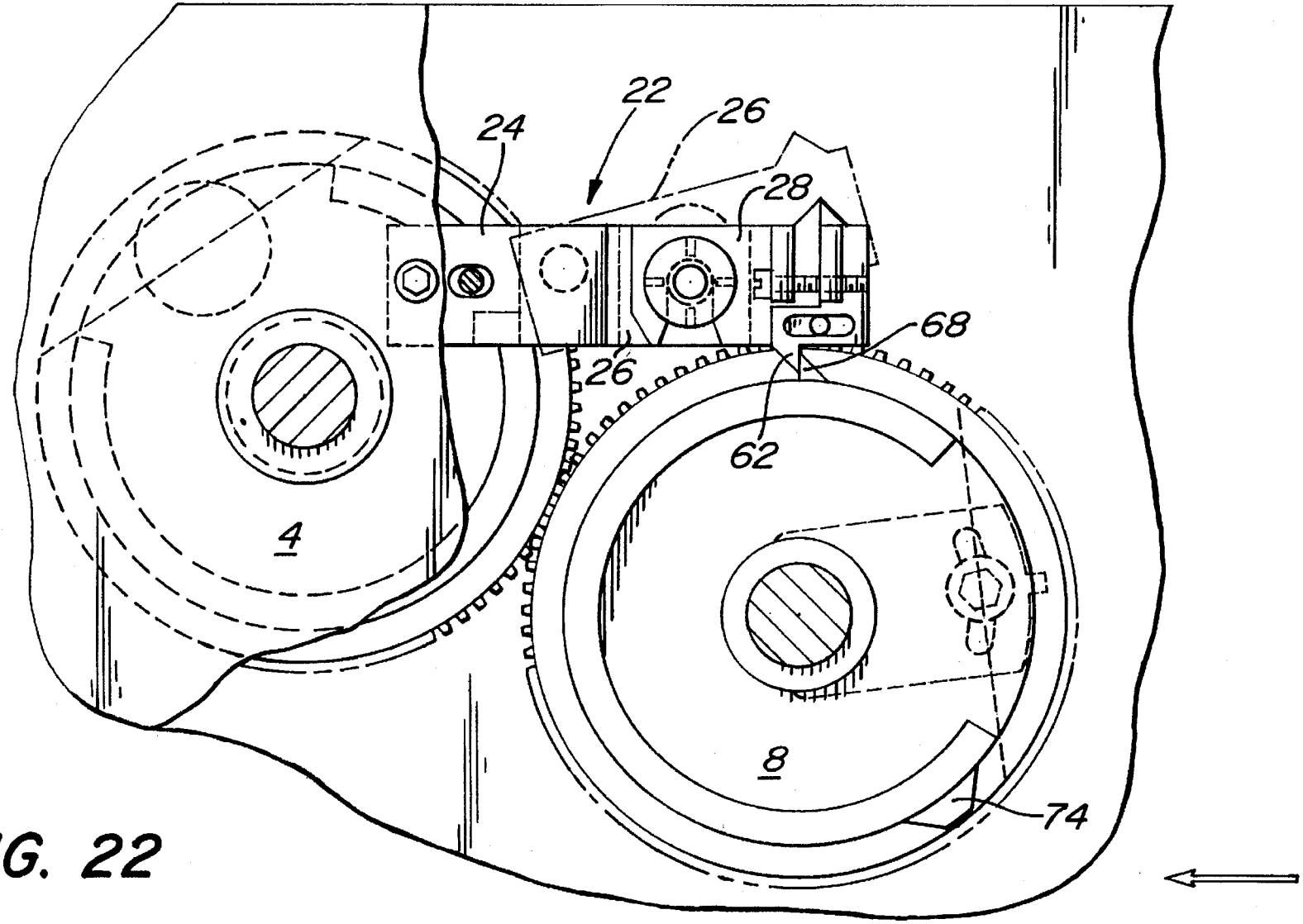
FIG. 22 is a side view of the cylinder positioner mounted on a single-color station or press.

Referring now to FIG. 22, the cylinder positioner 22 is shown mounted on a single-color press or station. Naturally, in this case, only one adjustment stop 68 is required.

In use, for a multi-station press, the cylinder positioner can be mounted on each station, or the mounting bracket 24 can be connected at each station with the positioner holding member 26 attached, and the removable positioner adjustment member 28 moved from station to station for alignment of the cylinders of each station.

Several embodiments of a cylinder positioner apparatus have been described. Various embodiments are shown because, in retrofitting the cylinder positioner apparatus to existing presses, or during manufacture, the configuration of the press may necessitate changes in the placement and structure of the components of the cylinder positioner apparatus. Thus, the cylinder positioner apparatus of this invention is applicable to a wide variety of offset presses and duplicators and is not limited to exact structures or placements shown in the embodiments which were described.

A cylinder positioning apparatus has been described which enables the operators of printing presses to vertically align multicolor or single-color presses accurately and rapidly. The apparatus may be installed during manufacture or retrofitted to existing machines. Various embodiments have been shown to meet specific needs and to operate with a wide variety of presses.

Without further elaboration, the foregoing will so fully illustrate this invention that others may, by applying current or future knowledge, readily adapt the same for use under the various conditions of service.

What is claimed is:

1. A method for vertically aligning the color plate cylinders of a press which prints a two-color image on paper, using a cylinder positioner mounted on said press by a mounting bracket, said cylinder positioner comprising a positioner stop, and said press comprising a first color plate cylinder, a second color plate cylinder, a blanket cylinder and an impression cylinder, said second color plate including gearing with said blanket cylinder, said method comprising the steps of:

(a) operating said press to print said two-color image on said paper;

(b) detaching said cylinder positioner from said mounting bracket;

(c) adjusting the position of said positioner stop to correspond to the amount of vertical misalignment of said colors on said paper;

(d) reattaching said cylinder positioner to said mounting bracket;

(e) decoupling said second color plate cylinder from its gearing;

(f) rotating said blanket cylinder, while holding said second color plate cylinder stationary, until an adjustment stop on said blanket cylinder is positioned against said positioner stop;

(g) recoupling said second color plate cylinder to its gearing; and (h) operating said press to print said two-color images on said paper.

2. The method of claim 1 wherein said mounting bracket comprises means for moving said cylinder positioner to an initial rest position and to an adjustment position, and said method further comprises the steps of:

(a) moving said cylinder positioner to said initial rest position prior to step 25(*a*);

(b) moving said cylinder positioner to said adjustment position prior to step 25(*e*); and (c) moving said cylinder positioner back to its initial rest position after step 25(*g*).

3. The method of claim 2 wherein said method further includes the step of repeating steps 25(*a*)–(*h*) and 26(*a*)–(*c*) until said misalignment is eliminated.

4. The method of claim 3 wherein said cylinder positioner further comprises a first pointer connected to said positioner stop, a second pointer and an adjustment screw for moving said second pointer relative to said first pointer, and said step of adjusting the position of said positioner stop, step 25(*c*), comprises the steps of:

(a) lining up said first pointer with the edge of said first color image; and (b) rotating said adjustment screw to line up said second pointer with the edge of said second color image.

5. The method of claim 4 wherein said mounting bracket comprises bolts and elongated holes, said method further including the step of adjusting the position of said mounting bracket within the limits set by said elongated holes.

6. The method of claim 5 wherein said position of said adjustment stop is adjustable in relation to another adjustment stop on said blanket cylinder, and said method further comprises the step of adjusting the position of said adjustment stop relative to said another adjustment stop.

7. The method of claim 4 wherein said mounting bracket comprises an elongated arcuate sweep bracket attached to said cylinder positioner and having an elongated arcuate slot and a fixed bracket, and said method further comprises the step of positioning said cylinder positioner by sliding said arcuate bracket within said fixed bracket connected to said press.

8. The method of claim 7 wherein said position of said adjustment stop is adjustable in relation to another adjustment stop on said blanket cylinder, and said method further comprises the step of adjusting the position of said adjustment stop relative to said another adjustment slot.

* * * * *